US005117213A

United States Patent [19]

Kreuter et al.

[11] Patent Number: 5,117,213

[45] Date of Patent: May 26, 1992

[54] ELECTROMAGNETICALLY OPERATING SETTING DEVICE

[75] Inventors: Peter Kreuter, Aachen; Armin Zoschke, Herzogenrath both of Fed. Rep. of Germany

[73] Assignee: FEV Motorentechnik GmbH & Co. KG, Aachen, Fed. Rep. of Germany

[21] Appl. No.: 542,931

[22] Filed: Jun. 25, 1990

[30] Foreign Application Priority Data

Jun. 27, 1989 [DE] Fed. Rep. of Germany ..... 3920931

[51] Int. Cl.[5] ..... F01L 9/04; F01L 9/02

[52] U.S. Cl. ..... 335/219; 335/266; 335/274; 74/559; 60/545; 123/90.11; 123/90.12

[58] Field of Search ..... 335/219, 266, 268, 273, 335/274; 74/559, 110, 828, 833, 834; 60/533, 545; 251/129.2; 123/90.11, 90.12

[56] References Cited

U.S. PATENT DOCUMENTS

| | | | |
|---|---|---|---|
| 4,245,596 | 1/1981 | Bruder et al. | 123/90.12 |
| 4,269,388 | 5/1981 | Seilly et al. | 123/90.11 |
| 4,375,793 | 3/1983 | Seilly et al. | 123/90.11 |
| 4,455,543 | 6/1984 | Pischinger et al. | 335/266 |
| 4,593,658 | 6/1986 | Moloney | 123/90.11 |
| 4,762,095 | 8/1988 | Mezger | 123/90.11 |
| 4,791,895 | 12/1988 | Tittizer | 123/90.11 |

FOREIGN PATENT DOCUMENTS

| | | | |
|---|---|---|---|
| 0043280 | 3/1980 | Japan | 123/90.11 |

*Primary Examiner*—Leo P. Picard
*Assistant Examiner*—Ramon M. Barrera
*Attorney, Agent, or Firm*—Watson, Cole, Grindle & Watson

[57] ABSTRACT

To adjust the stroke of a control element actuated electromagnetically by means of a spring-mass oscillating system for displacement engines and to enable a freer arrangement of the electromagnetic setting device in the housing, in particular in a cylinder head of a displacement engine, the movement of the setting device is transferred to the control element, in particular one or more lift valves or flat slide valves, by means of a mechanical or hydraulic transmission system whose transformation ratio varies. Furthermore, devices are provided to adjust with precision the equilibrium position of the oscillating system. The electromagnetic setting device can also be combined with an end position attenuator and with a hydraulic compensating element.

27 Claims, 5 Drawing Sheets

ELECTROMAGNETICALLY OPERATING SETTING DEVICE

RELATED APPLICATIONS

This application relates to U.S. Ser. No. 542,951, filed June 25, 1990, which corresponds to German application Ser. No. P 39 20 976.8 and U.S. Ser. No. 542,949, filed June 23, 1990, which corresponds to German application P 39 20 978.4, which are commonly owned with the present application and the specifications of which are herein incorporated by reference.

BACKGROUND OF THE INVENTION

1. Technical Field of the Invention

The present invention relates to an electromagnetically operating setting device for oscillatingly movable control elements of displacement engines, in particular for flat slide valves and lift valves, comprising a spring system and two electrically operating switching magnets, by means of which an armature actuating the control element can be moved into two discrete, opposing switching positions and can be held there by one of the switching magnets, wherein the equilibrium position of the spring system lies between the two switching positions.

2. Discussion of the Related Art

Such a setting device is known from German published patent application DE-0S 30 24 109. In a setting device of this kind the control element of a displacement engine is held in the closed state by a compression spring. Another compression spring acts on an armature interacting with the control element so that the position of equilibrium of the spring system lies in the center or near the center between the end positions of the movement of the armature. The end positions of the movement of the armature are respectively located at an electrically actuated working magnet. To switch this device, one working magnet is excited and the other is switched off. Due to the force of the prestressed spring, the armature is accelerated as far as the position of equilibrium and delayed on its further path by the then determining counteracting force of the other spring. Due to the resulting friction, the armature cannot reach the opposing end position. The armature is then attracted by the tractive force of the switching magnet over the remaining distance.

In contrast to switching systems that attract the armature against the force of the spring over the entire stroke, with this system a significant reduction in the constructive size is achieved since, owing to the small air gap to be bridged, the radial dimension of the winding window can be kept small. This is especially important with respect to the use of the setting device on displacement engines.

The working stroke of such a setting device is designed in such a manner that an opening has an adequate cross-section for the largest mass flow at the control element of a displacement engine to avoid throttling. With the smaller mass flows which occur when displacement engines, and especially internal combustion engines, are operating under partial load, operating the setting device at this maximum working stroke is inefficient since the electric energy to be supplied to change the position of the control element increases as a function of the stroke of the control element. Furthermore, a decrease in the crosssection of the opening results in an increase in the velocity of flow at the control element, a state that contributes to an improvement in the multi-phase fuel induction, especially in the air/fuel mixing in internal combustion engines. However, in the prior design, the maximum stroke of the control valve that can be carried out is limited by the measurements of the setting device and by the preselected positioning in extension of the axis of the valve and thus cannot be modified.

Accordingly, it is an object of the present invention to achieve a flexible adaptation of the setting device to the respective operating conditions and simultaneously save energy with as compact dimensions as possible of the setting device and freer arrangement of the setting device in the housing, in particular in the cylinder head of an internal combustion engine.

Other objects and advantages are apparent from the specification and drawing which follow.

SUMMARY OF THE INVENTION

The foregoing and additional objects are achieved in that the length of travel of the setting device is transferred via a transmission system whose transformation ratio varies, in particular via a rocker arm or finger follower, to the control element in displacement engines and thus to the lift valve or the flat slide valve.

To design the configuration of setting unit, transmission system, and control element so as to be variable, it is expedient to transfer the force by means of push rods.

According to another embodiment of the invention, the transmission system is designed as a hydraulic power transmission whose transformation ratio varies.

According to another embodiment of the invention, the oscillatory spring-mass system with compression springs on both sides of the armature is designed in such a manner that the springs or sets of springs are divided into springs arranged on the magnet side and springs arranged on the control element side.

According to another embodiment of the invention, it is provided that several control elements interact with one transmission system each, wherein valve controlled displacement engines have one transmission system each per valve or one common transmission system for several valves.

According to another embodiment of the invention, it is provided to adjust the position of equilibrium of the oscillating system by providing that the base of one or several springs of the oscillatory system is adjustable to various fixed positions. The goal here is that the adjustment in the receiving housing, in particular in the cylinder head of an internal combustion engine, be readily accessible since the correct adjustment of the position of equilibrium is done under operating conditions. According to other embodiments, this adjustment is made either directly via a displacement of wedge surfaces relative to one another or via a transfer element, which is designed as a rocker arm or finger follower.

According to another embodiment of the invention, a hydraulic length element is provided to actuate free from the lash of the oscillatingly moved components. According to the invention, the compensating element can be arranged at different positions within the moved components, in particular in the transmission system or in the armature of the magnet.

According to another embodiment of the invention, the hydraulic compensating element is arranged between the receiving housing and the switching magnet assigned to the closed valve position, wherein the axial displacement of the switching magnet compensates for the linear changes occurring in the moved components.

Another advantageous embodiment of the invention constitutes the arrangement of the hydraulic length compensating element between the mounting of the transmission element and the receiving housing or the adjusting element.

Another advantageous embodiment of the invention consists of the use of permanent magnets in the switching magnets.

Another embodiment of the invention relates to an attenuation of the movement of the armature shortly before reaching the end positions.

To correct the position of equilibrium of the oscillating system when the transformation ratio is changed, the base of one of the springs or sets of springs assigned to the oscillatory system can be adjusted.

According to another embodiment of the invention, the magnetic reluctance of the magnetic circuit of one or both working magnets is changed with the change of the transformation of the transmission system and, thus, when changing the effective spring forces, with the goal of keeping the time span between switching the current of a working magnet off and the start of the movement of the armature, called the decay time in the following, constant.

According to another embodiment of the invention, the magnetic reluctance is changed and the transformation of the transmission element and the position of equilibrium of the oscillating system is adjusted by one common device.

BRIEF DESCRIPTION OF THE DRAWINGS

Embodiments of the invention are described in detail with reference to the drawings, wherein.

DETAILED DESCRIPTION OF THE PREFERRED EMBODIMENTS

Figure 1:
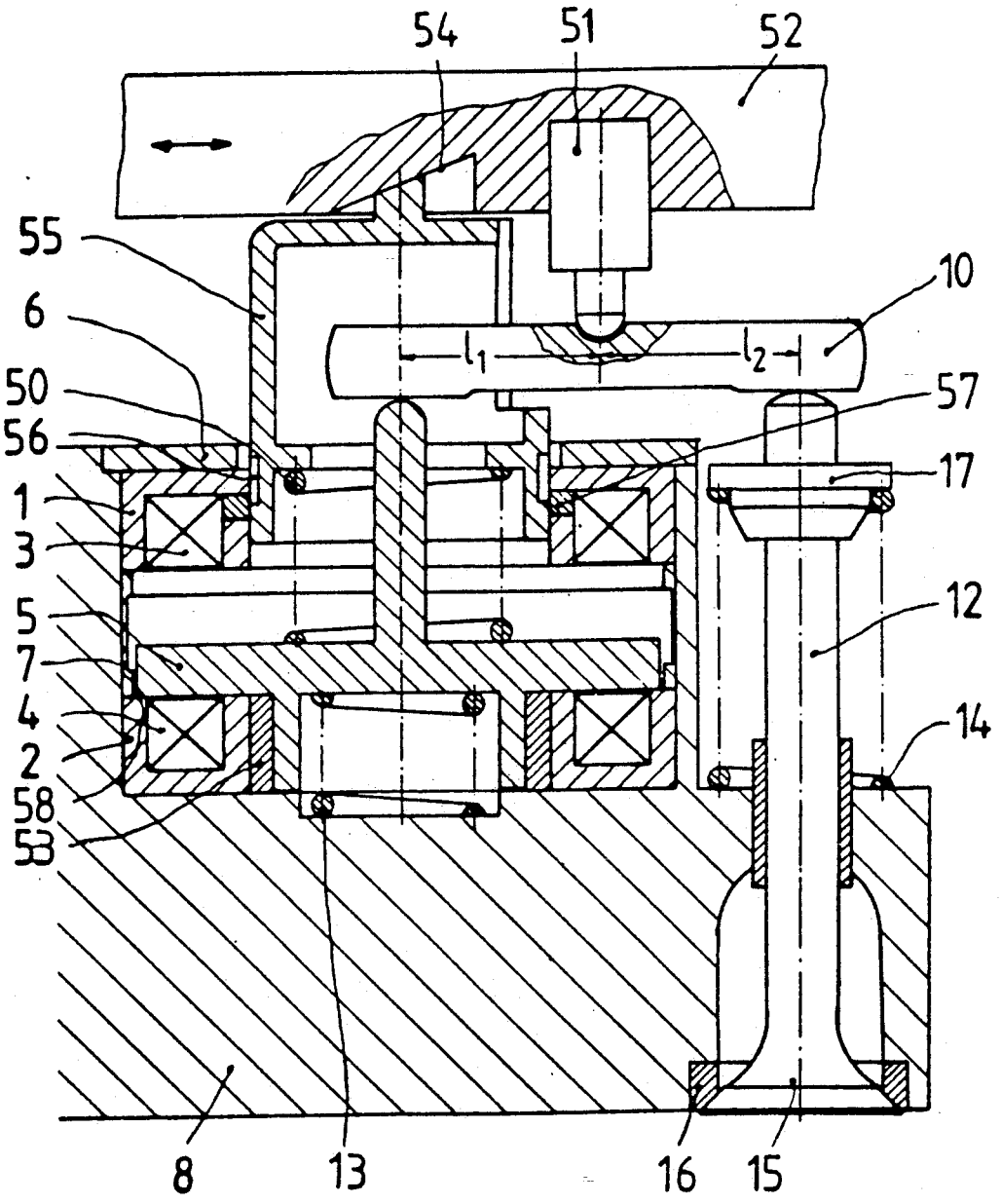
FIG. 1 is a longitudinal sectional view of an embodiment of the device of the invention with a rocker arm as the transmission system and an adjustment of the position of equilibrium of the oscillating system is achieved by displacing a spring base and changing the magnetic reluctance of the opening magnet and, furthermore, a hydraulic valve lash compensating element and an end position attenuation of the armature are shown.

The present invention will now be described in greater detail with reference to the accompanying drawings. Referring to FIG. 1, an electromagnetically operating setting device is shown with electromagnets 1 and 2, windings 3 and 4, and armature 5. Electromagnets 1 and 2 are clamped permanently into housing 8 by means of a cover 6 and with the insertion of a lifting ring 7. Armature 5 is guided in a sleeve 53 and actuates a rocker arm 10 and thereby actuates a valve 12. With consideration of the transformation ratio of the rocker arm 10, compression springs 13, 14, and 50 form an oscillatory system with armature 5, rocker arm 10 and valve 12. Spring 14 is braced at the shaft of valve 12 via a spring washer 17. The movement of armature 5 is delayed by compression of air in the vicinity of the pole surface of magnet 2. To this end, the lifting ring 7 is provided with grooves in such a manner that prior to the armature 5 making contact with the pole surface, the exit cross-section 58 between armature 5 and lifting ring 7 is decreased.

Rocker arm 10 is braced via a hydraulic length compensating element 51 in adjusting element 52. When valve 12 is closed, the acting force of the prestressed compression spring 14 is braced via spring washer 17, the shaft of valve 12 and the valve disk 15 at valve seat 16. Armature 5 rests on switching magnet 2, and in particular with a retention force that is greater than the force of the prestressed compression spring 13 minus the force of spring 50. Thus, rocker arm 10 is without force so that inserted hydraulic compensating element 51 can compensate for the length change and thus ensure that when armature 5 abuts the pole surface of electromagnet 2, the valve disk 15 abuts valve seat 16.

When adjusting element 52 is actuated, a soft magnetic sleeve 55 braced at an inclined plane 54 in adjusting element 52 changes the prestress of spring 50 and, thus, corrects the position of equilibrium of the oscillating system. Furthermore, the soft magnetic sleeve 55 contains an annular recess 56 which is displaced upon movement of sleeve 55 relative to a magnetic impermeable ring 57 arranged in magnet 1. Depending on the position of the soft magnetic sleeve 55, the result is a variable magnetic reluctance in the magnetic circuit of magnet 1.

To enlarge the stroke of the valve 12, the adjusting element 52 is moved to the left. Thus, lever arm 1 decreases and lever arm 2 is increased as the fulcrum is adjusted Thus, both the prestressing force of spring 14 acting on armature 5 and its spring rigidity are reduced on the armature side. To compensate for the resulting displacement of the position of equilibrium of the oscillating system, the prestressing force of spring 50 is reduced by means of the movement of sleeve 55. The retention forces at the opening magnet 1 increasing with the rising stroke are balanced by decreasing the magnetic reluctance in magnet 1 so that the requisite holding current and the decay time of the armature remain constant. This change is also caused through the movement of sleeve 55. When the stroke is to be decreased, the process is conducted analogously in reverse.

Figure 2:
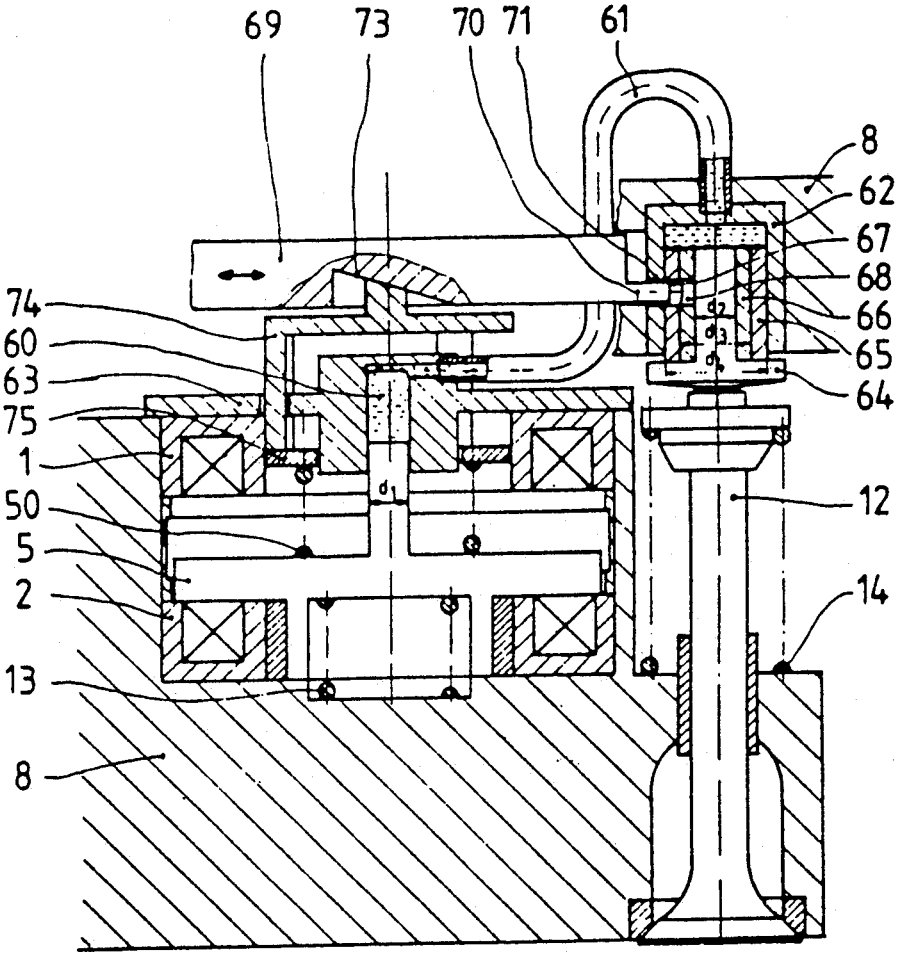
FIG. 2 is a longitudinal sectional view of an embodiment of the device with a hydraulic transmission system.

FIG. 2 shows an electromagnetically operating setting device with an hydraulic transmission system, comprising as above electromagnets 1 and 2, armature 5, valve 12 and springs 13, 14 and 50. When moved, armature 5 displaces oil from chamber 60, which is located in cover 63 of the setting device, through line 61 and into cylinder 62. In cylinder 62 there is a three-divided piston, comprising actuating mushroom 64 and bushings 65 and 66. These bushings have on their circumference one bore 67 and 68, respectively, and similarly cylinder 62 has a bore 71. The bores of all three components align when valve 12 is in its closed position. Adjusting element 69 has on its end a pin-shaped extension 70, which is guided in the bore 71 of cylinder 62 and can reach into bores 67 and 68 when adjusting element 69 is displaced to the right in FIG. 2. Thus, bushing 65 and also bushing 66 can be fixed relative to mushroom 64. The transformation ratio results from the ratio of the diameter of these acting cylinders, i.e., the acting area contacting the oil, being changed from d1 to d2, d3 or d4. Furthermore, the adjusting element 69 has an inclined plane 73, which adjusts the prestressing of the spring 50 by means of a sleeve 74 and a spring washer 75 and thus corrects the position of equilibrium of the oscillating system and the magnetic reluctance of permanent magnet 1 as above.

Figure 3:
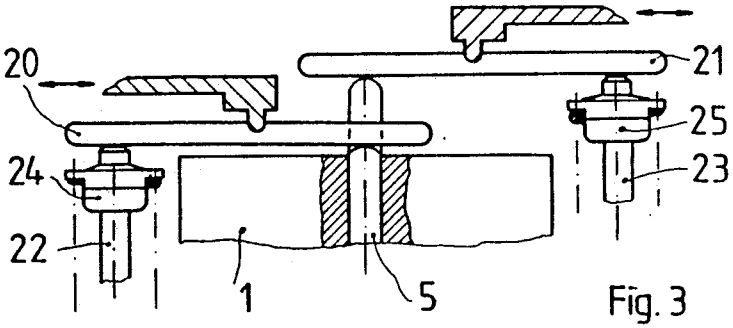
FIG. 3 is a side view of an embodiment with two actuated valves per setting device.
Figure 4:
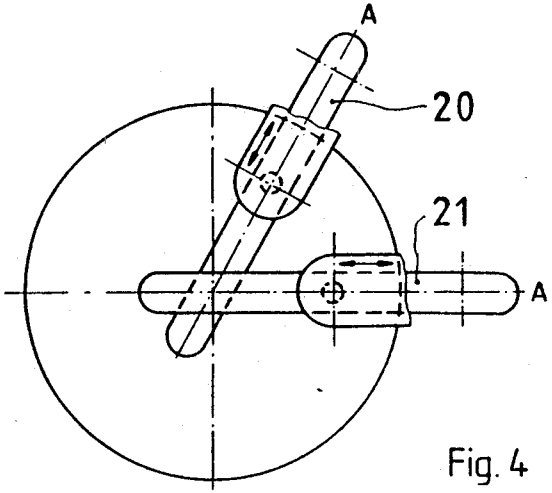
FIG. 4 is a top view of the embodiment of FIG. 3.

FIGS. 3 and 4 show an arrangement of two rocker arms 20 and 21 which respectively actuate two valves or pushers 22 or 23.

Figure 5:
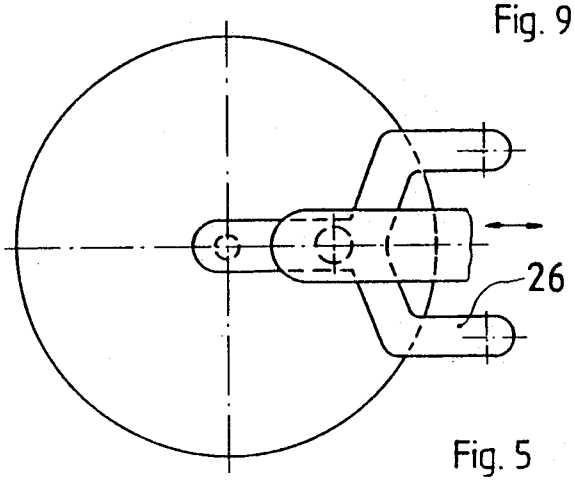
FIG. 5 is a top view of another embodiment with a common rocker arm actuating two valves.

FIG. 5 shows an arrangement to actuate two valves or pushers by means of one common rocker arm 26. Thus, it is possible to actuate two or more valves or pushers with negligible valve space.

Figure 6:
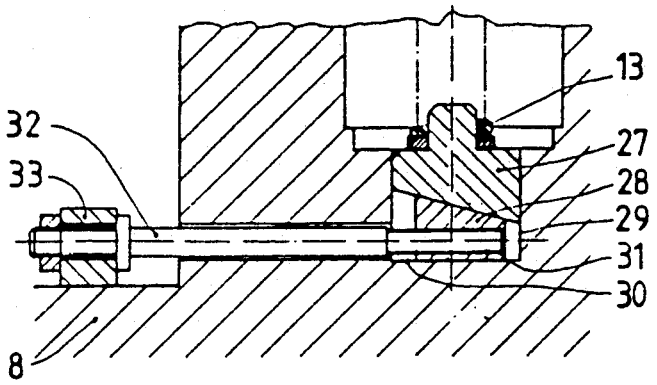
FIG. 6 is a sectional view of an embodiment to adjust the equilibrium posit,,ion of the oscillating system of the invention.

FIG. 6 shows a device to set the position of equilibrium of the oscillating system as desired. The position of the base of spring 13 is adjusted via respective wedge surfaces of two components 27 and 28. Component 27 is guided in a bore 29 of housing 8. Component 28 rests on the planar bottom 30 of bore 29 and contains a radial tapped hole 31. A bolt 32 is stopped in its axial displacement by a stop 33 in housing 8 and moves upon rotation of component 28 in the direction of the longitudinal axis of the bolt. The device is self-locking.

Figure 7:
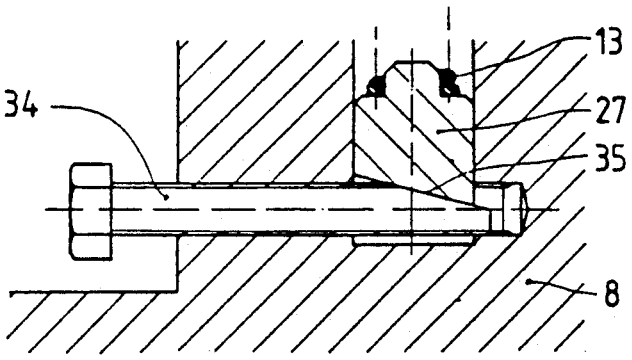
FIG. 7 is a sectional view of another embodiment to adjust the equilibrium position of the oscillating system of the invention.

FIG. 7 shows a device to adjust the position of equilibrium as described above, wherein, however, a screw 34 formed with a wedge-shaped, inclined plane 35 as the counterpart to component 27. In this embodiment, however, the wedge surfaces are opposite one another only at a precisely defined position per revolution of screw 34 so that the position of equilibrium is adjusted in discrete steps. The described device is also selflocking.

Figure 8:
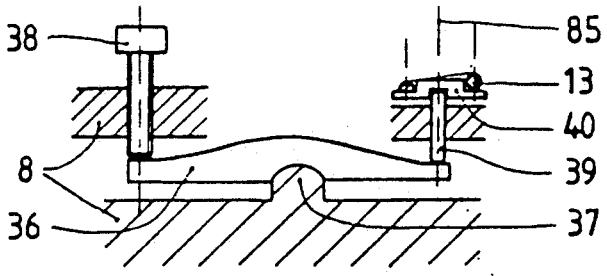
FIG. 8 is a sectional view of yet another embodiment to adjust the equilibrium position of the oscillating system of the invention.

FIG. 8 shows a device to adjust the position of equilibrium, which is accessible in an axis parallel to the longitudinal axis 85 of the setting device. A lever 36 rests on an abutment 37 and is positioned by means of a set screw 38 which is braced in housing 8 The other end of adjusting lever 36 acts via a guided pin 39 on spring washer 40. The described device is self-locking in accordance with the choice of thread pitch of screw 38.

Figure 9:
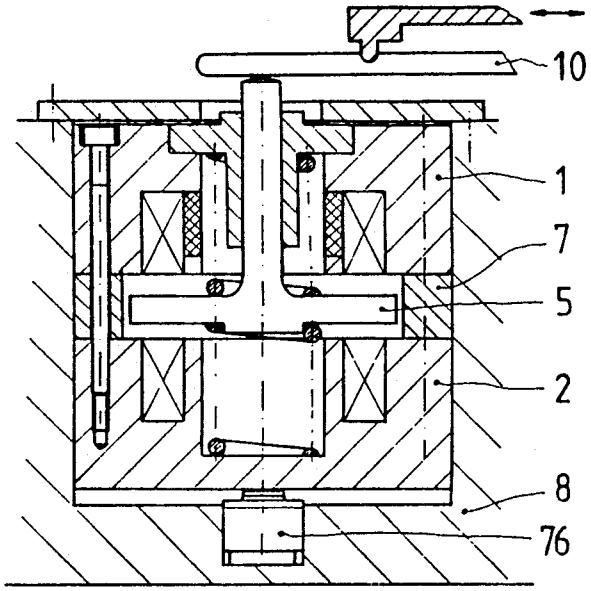
FIG. 9 shows another advantageous arrangement of the hydraulic compensating element of the invention.

FIG. 9 shows another possible arrangement of a hydraulic compensating element 76 between housing 8 and magnet 2 that is assigned to the closing position and belongs to an electromagnetic setting device. When armature 5 abuts magnet 2, an axially displaceable module, comprising magnets 1 and 2 and lifting ring 7, can adjust the length compensation between armature 5, rocker arm 10 and valve by means of the force of a compression spring acting inside the compensating element 76. A permanent magnet 3*a* may be located near one of the two electromagnets 1 or 2.

Figure 10:
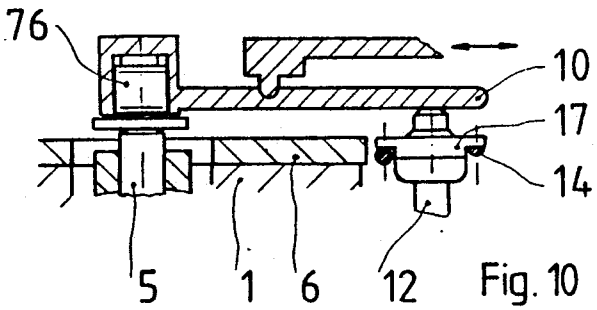
FIGS. 10 and 11 are sectional views of further embodiments of the compensating element.
Figure 11:
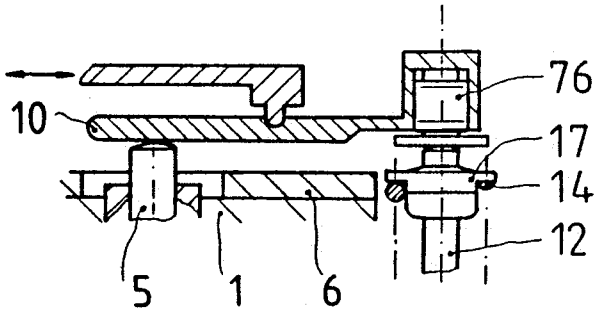

FIGS. 10 and 11 show other possible embodiments of the hydraulic compensating element located at respective ends of rocker arm 10.

Figure 12:
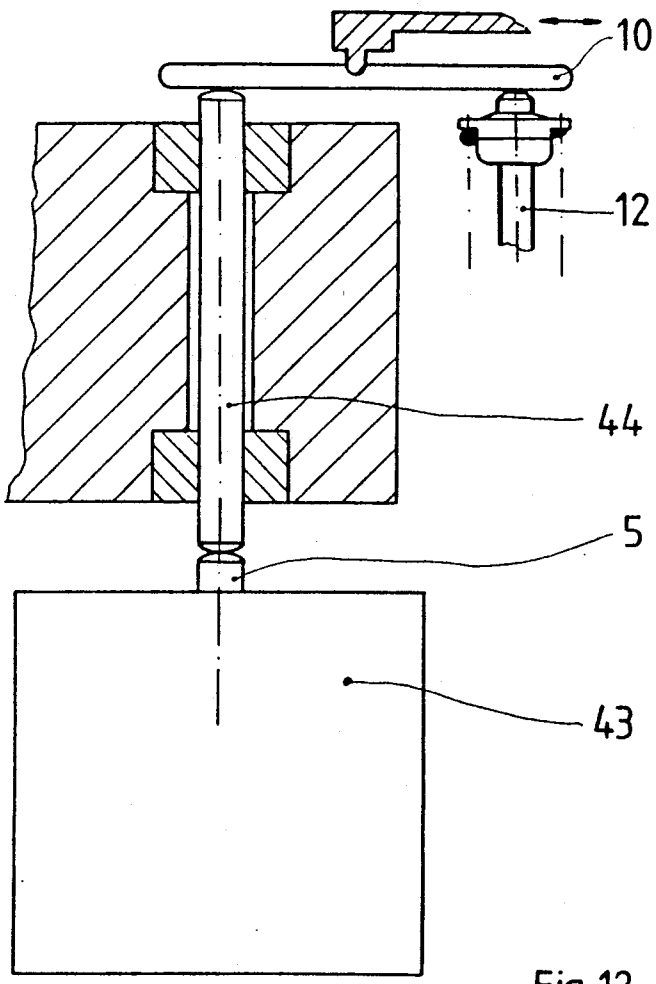
FIG. 12 shows an arrangement of the setting device transmission/element and control element in which the force is transferred with the aid of a push rod.

FIG. 12 shows another arrangement of setting unit 43, transmission element 10 and control element 12, wherein the force is transmitted by means of a push rod 44.

From the foregoing, with the present invention the length of travel of the setting device and thus the effective cross-section of the opening of the lift valve or flat slide valve can be changed in an advantageous manner while largely maintaining the compact dimensions of the setting device Furthermore, in comparison to the arrangement of a setting device in direct extension of the shaft of the control element, it is possible to enlarge the maximum stroke of the control element. Another advantage lies in the fact that the setting device can be arranged around the valve shaft within a radius defined by the transmission system and thus a greater design freedom of the receiving housing is targeted It is also possible with the invention to accurately adjust the position of equilibrium of the oscillating system in the installed state, and to correct the position of equilibrium of the oscillating system when the transformation ratio of the transmission system is changed. By changing the magnetic reluctance of the magnetic circuit it is possible to set constant decay times of the armature at different transformation ratios of the transmission system. Furthermore, it is possible to compensate in an advantageous manner for the linear changes of the moved components, resulting from thermal expansion or wear, with a hydraulic compensating element, whose position in the setting device can be chosen in such a manner that a negative effect on the switching time of the setting device determined by the mass and spring rigidity is avoided Further modifications and improvements will be apparent to one skilled in the art without departing from the spirit and scope of the present invention as defined by the following claims.

We claim:

1. An electromagnetically operating setting device for at least one oscillatingly movable control element of a displacement engine, comprising:

two switching electromagnets defining switching positions corresponding to opened and closed position of at least one control element;

an armature located between said two electromagnets;

a spring system for oscillating said armature between the two switching positions and said spring system having an equilibrium position between the two switching positions;

a transmission system in communication with said armature and at least one control element, whereby said armature actuates at least one control element between opened and closed positions; and means for varying the transmission ratio of said transmission system.

2. The setting device according to claim 1, wherein said transmission system is a mechanical transmission system.

3. The setting device according to claim 1, further comprising a push rod located between said armature and said transmission system.

4. The setting device according to claim 1, wherein said transmission system is a hydraulic transmission system.

5. The setting device according to claim 1, wherein said spring system comprises at least one spring communicating with said armature and said transmission system and at least one spring communicating with the control element and said transmission system.

6. The setting device according to claim 5, wherein the springs have varying spring rigidities.

7. The setting device according to claim 1, wherein said transmission system is in communication with said armature and at least one additional control element whereby said armature actuates the control elements.

8. The setting device according to claim 1, wherein said transmission system is connected to an oscillatory system comprising said spring system, armature and control element and further comprising means for adjusting the equilibrium position of the oscillatory system.

9. The setting device according to claim 8, wherein said spring system comprises a first spring communicating with one side of said armature and said transmission system, a second spring communicating with the control element and said transmission element, and a third spring communicating with an opposite side of the armature and an adjustable base.

10. The setting device according to claim 9, wherein the adjustable base comprises a first component having a surface in communication with the third spring and having an opposite wedge shaped surface, and further comprises a second component with a wedge shaped surface confronting the first wedge shaped surface and means for displacing the second wedge shaped surface relative to the first wedge shaped surface.

11. The setting device according to claim 10, wherein the displacing means comprises a threaded member communicating with the second component.

12. The setting device according to claim 10, wherein the second component is integrally formed with a thread of a threaded member.

13. The setting device according to claim 8, wherein the means for adjusting the equilibrium position comprises a rocker arm or finger follower.

14. The setting device according to claim 1, further comprising a compensating element for lash generated by said transmission system.

15. The setting according to claim 14, wherein said compensating element is located between said transmission system and said armature.

16. The setting according to claim 14, wherein said compensating element is located between said transmission system and the control element.

17. The setting device according to claim 14, wherein said compensating element is mounted on a housing and connected to said transmission system.

18. The setting device according to claim 14, wherein said compensating element is arranged between a housing and said electromagnet defining the switching position corresponding to the closed position of the control element.

19. The setting device according to claim 1, further comprising a permanent magnet located near one of said two electromagnets.

20. The setting device according to claim 1. further comprising a brake to brake the oscillating of said armature in the vicinity of at least one of the end positions.

21. The setting device according to claim 1. wherein said spring system comprises at least one spring and further comprising means for simultaneously changing the transmission ratio and changing the position of a spring base of at least one spring of said spring system to adapt the equilibrium position of said spring system to the changed transmission ratio.

22. The setting device according to claim 1 , further comprising means for changing the magnetic reluctance in an associated magnetic circuit of one or both electromagnets to adjust the decay time of the spring moved armature.

23. The setting device according to claim 21, wherein the transmission system comprises a lever having two ends respectively abutting said armature and the control element, and further comprising an adjusting element which adjusts the fulcrum of the lever and simultaneously adjusts the position of a magnetic sleeve relative to one of said electromagnets to simultaneously change the magnetic reluctance thereof, the magnetic sleeve also abutting a spring of said spring system, whereby the equilibrium position of said spring system is also simultaneously adjusted when the position of the magnetic sleeve is adjusted.

24. The setting device according to claim 1, wherein the transmission system comprising a hydraulic system which comprises a first hydraulic cylinder in fluid communication with said armature, a second hydraulic cylinder in communication with the first hydraulic chamber, and an actuator having a contacting area in communication with the second hydraulic fluid chamber and the control element, and said means for varying the transmission ratio comprises means for varying the contacting area of the actuator.

25. The setting device according to claim 24, wherein the area varying means comprises at least one bushing surrounding the actuator and means for connecting and disconnecting at least one bushing to and from the actuator, whereby the hydraulically active area of the actuator is varied.

26. The setting device according to claim 25, wherein the connecting and disconnecting means comprises a pin insertable through respective bores in at least one bushing of the actuator, and an adjusting element for inserting the pin.

27. The setting device according to claim 26, further comprising a magnetic sleeve and wherein the adjusting element adjusts the position of the magnetic sleeve relative to one of said electromagnets to simultaneously change the magnetic reluctance of this electromagnet when the pin is inserted into and withdrawn from the bores, the magnetic sleeve also abutting a spring of said spring system, whereby the equilibrium position of said spring system is also simultaneously adjusted when the position of the magnetic sleeve is adjusted.

* * * * *